US007254962B2

(12) United States Patent
Scharr

(10) Patent No.: US 7,254,962 B2
(45) Date of Patent: Aug. 14, 2007

(54) JEWELRY SYSTEM

(76) Inventor: Paul R. Scharr, 6574 E.Crested Saguaro Ln., Scottsdale, AZ (US) 85262

( * ) Notice: Subject to any disclaimer, the term of this patent is extended or adjusted under 35 U.S.C. 154(b) by 0 days.

(21) Appl. No.: 11/486,648

(22) Filed: Jul. 14, 2006

(65) Prior Publication Data

US 2006/0248922 A1 Nov. 9, 2006

Related U.S. Application Data

(63) Continuation-in-part of application No. 10/966,656, filed on Oct. 16, 2004, now abandoned, which is a continuation-in-part of application No. 10/834,716, filed on Apr. 28, 2004, now abandoned.

(51) Int. Cl.
*A44C 25/00* (2006.01)

(52) U.S. Cl. ..... 63/40; 63/33; 63/35

(58) Field of Classification Search ..... 59/2, 59/80, 82, 83, 85; 29/896.4, 896.41, 896.411, 29/896.42; 63/33, 35, 38, 40, 41, 1.16, 1.17, 63/3

See application file for complete search history.

(56) References Cited

U.S. PATENT DOCUMENTS

| | | | | |
|---|---|---|---|---|
| 213,215 | A * | 3/1879 | Lewis | 24/115 R |
| 1,197,322 | A * | 9/1916 | Wolf | 63/3 |
| 1,314,803 | A | 9/1919 | Heller | |
| 1,455,993 | A | 5/1923 | Conway | |
| 1,795,674 | A | 3/1931 | Potter | |
| 2,449,167 | A * | 9/1948 | Hopewell | 24/645 |
| 4,216,567 | A * | 8/1980 | Heinz | 24/116 A |
| 4,219,919 | A | 9/1980 | Fischbein et al. | |
| 4,783,974 | A | 11/1988 | Hernandez | |
| 4,907,322 | A | 3/1990 | Kanno | |
| 5,097,679 | A | 3/1992 | Johnson et al. | |
| 5,398,391 | A | 3/1995 | Yokochi | |
| 5,528,909 | A * | 6/1996 | Tonakawa | 63/3 |
| 5,794,459 | A * | 8/1998 | Ignatowski | 63/38 |
| 6,027,213 | A * | 2/2000 | Ignatowski | 351/52 |
| 6,083,267 | A | 7/2000 | Motomiya et al. | |
| 6,088,884 | A | 7/2000 | Hentz | |
| 6,289,559 | B1 | 9/2001 | Langer | |
| 6,357,261 | B1 | 3/2002 | Cheng | |
| 6,446,466 | B1 | 9/2002 | Headley | |
| 6,681,598 | B2 | 1/2004 | Cheng | |

(Continued)

*Primary Examiner*—Jack W. Lavinder
(74) *Attorney, Agent, or Firm*—LaValle D. Ptak

(57) ABSTRACT

A jewelry system is provided with interchangeable components including at least one jewelry portion comprised of beads on a wire with first and second free ends. The first and second free ends of the wire pass through holes in corresponding first and second threaded caps; and corresponding findings are permanently affixed to the first and second free ends of the wire after passage of the wire through the holes in the caps to hold the beads on the wire between the threaded caps. First and second main body portions, each closed on one end and open on the opposite end with a threaded chamber therein, receive the first and second caps, respectively, with the findings located in the chambers in the main body portions. The fixed loops on the closed end of each of the main body portions are attached to additional jewelry components to allow interchangeability between the first jewelry portions and the additional jewelry components by interconnecting the caps of different first jewelry portions with different body portions attached to various jewelry components.

8 Claims, 10 Drawing Sheets

U.S. PATENT DOCUMENTS 6,718,797 B2 * 4/2004 Plumly ..... 63/18
6,729,159 B2 5/2004 Rose
2004/0020240 A1 * 2/2004 Brancato ..... 63/3
2006/0005575 A1 * 1/2006 LaRocca ..... 63/3

* cited by examiner

JEWELRY SYSTEM

RELATED APPLICATIONS

This application claims priority of and is a continuation-in-part of U.S. application Ser. No. 10/966,656 filed Oct. 16, 2004 now abandoned, which in turn is a continuation-in-part of Ser. No. 10/834,716 filed Apr. 28, 2004, now abandoned.

FIELD OF THE INVENTION

The invention pertains to jewelry, in general, and to jewelry connectors and jewelry utilizing such connectors, in particular.

BACKGROUND OF THE INVENTION

Jewelry has always been considered an important element of a well-dressed individual, reflecting the personalities and taste of the wearer. Beaded jewelry started in ancient times as a craft using a series of artistic stones or metal pieces placed end-to-end on a string in various formations. Today, we have factories that arrange beads on various stringing materials to form bracelets, necklaces, watch bands, ankle bracelets, belts, handbag straps, waist jewelry or the like.

Stringing materials used today are predominately string, wire or chord. The type of material, size, weight and quality of the jewelry article usually determines the stringing mechanism, be it wire, chord, string that is selected by the designers.

Bead wire, made exclusively for the jewelry trade, comes in many diameters, is usually made of stainless steel wires woven together and then coated. It is typically strong, light and allows for a supple drape.

Beadwork assemblies are typically connected to a clasp, chain, or cable using string or wire.

String beadwork typically is finished by knotting the string and placing the end knot into some type of bead where the final bead or a metal finding holds and conceals the final knot.

Wire is preferred by designers when the application requires heavy beads and where the bead hole is abrasive. Abrasive bead holes can act like razors on a string or chord. The allure of stringing many different beads or stones and creating limitless design possibilities without having to worry about abrasive beads, makes using the bead wire versus string very attractive for jewelry assemblies by designers.

String beadwork is feasible due to the ability to knot a string. This remedy is not feasible for designs that use a wire for beadwork. Tying a knot in the bead wire weakens the wire. Consequently, wires are typically finished with metal findings, called crimps.

Crimps are small tubes of metal that are crushed with pliers or a specific crimping tool to hold wires together. Crimps fasten the wire to itself to form a loop that attaches to the clasp, chain or cable assemblies. This is accomplished by threading the wire through the crimp tube around a clasp or other article, and then back through the crimp tube. To close the loop, the crimp is then crushed with a crimp pliers or a needle nose pliers to hold the wire securely. Crimps of varying sizes are used depending on the size of the wire, the weight and size of the beads.

Additional problems with using bead wire are that a metal finding, such as a crimp, is exposed and raw beading wire is exposed. Metal findings are typically not very strong and often times will break causing the loss of the jewelry.

Metal findings become a piece of hardware as opposed to an element of design and are typically not found in high-priced jewelry since this would be considered not appealing by those that appreciate the art, since aesthetics are important factors in the value of the jewelry. One of the primary problems in trying to attach a bead wire to either a clasp, chain or cable is how to attach the wire without detracting from the overall appearance of the jewelry article.

Some jewelry designers use what is called French wire or bullion to cover over the raw bead wire which creates the loop. French wire is a spring-like coil of silver tint that is cut to length and placed over the exposed portion of the beading wire. French wire is a temporary solution, at best, as it soon frays and discolors and detracts from the overall appearance of the article of jewelry. The value of the pieces of jewelry often depends largely upon how the piece is put together.

While many of the prior connector elements may be suitable for low-end jewelry, they are not desirable solutions for high-end jewelry. How it is put together is an important factor for success in the high-end jewelry market.

Although the relevant body of art discloses devices for use with an article of jewelry, most all are directed towards either connecting to chain, cable or an improved clasp. For instance, U.S. Pat. No. 4,219,919 refers to connecting to chain, U.S Pat. No. 6,681,598 refers to connecting beads that are wired from eyelet to eyelet and are not a continuous wire strand. Similarly, U.S. Pat. No. 6,289,559 is a clasp appended to a knotted pearl necklace. U.S. Pat. No. 6,088,884, is still another clasp designed to be soldered to a chain. In most instances, particularly with the foregoing, the strand ends in prior art have loops that are either glued into the last bead for engagement to a clasp, or soldered to the end of a chain, or glued to a cord. None of the prior art addresses how to attach a bead wire to a clasp, chain, cable or the like and overcome the exposed metal findings and/or the exposed wire that detracts from the appearance of the article of jewelry. U.S. Pat. No. 5,398,391 refers to connecting a bead wire to a clasp. This patent eliminates the unsightly crimp, but does not eliminate the exposed raw bead wire that detracts from the appearance of the article of jewelry. None of the prior art addresses how to attach a bead wire to a clasp, chain, cable or the like without detracting from the appearance of the article of jewelry.

It is an object of the present invention to provide an improved jewelry system, which overcomes the aforementioned inadequacies of the prior art devices and provides a significant contribution to the jewelry industry.

It is an object of this invention to provide a jewelry system suitable for higher-end jewelry.

It is further an object of the present invention to provide a jewelry system with a connector which is easily installed on the ends of the bead portions and linkable components.

Another object is to provide a connector device for a jewelry system that minimizes the need for a high level of manual dexterity in assembly.

Still another object of the present invention is to provide a jewelry connector for a jewelry system that may incorporate a variety of styles, shapes, designs, decorative features. The shape of the connector may be of any jewelry type shape including cubical, spherical, cylindrical and other geometric shapes.

It is yet another object of this invention to provide a connector for a jewelry system that can be sized to allow for different amounts of holding power.

It is also an object of the present invention to provide a device that is easily manufactured and simple to use.

These and other objects of the invention are provided by a jewelry system in accordance with various embodiments of the invention.

SUMMARY OF THE INVENTION

In accordance with an embodiment of the invention, a connector for a jewelry system is provided that includes a first body member and a second body member adapted to be affixed to the first body member. The first and second body members cooperatively define a closed chamber. The closed chamber is sized to contain and restrain a metal finding attached to at least one jewelry wire. At least one of the first and second body members has an aperture through which a jewelry wire carrying said metal finding is extendable into the chamber prior to attachment of the metal finding to the free end of the wire.

A jewelry connector in accordance with an embodiment of the invention comprises a body with a chamber in it. The body also is adapted to receive a cap. The connector includes a cap adapted to be releasably affixed to the body to close the chamber. The cap includes an aperture sized to receive the free end of a wire. The chamber is sized to contain the wire free end and a metal finding affixed to the wire free end.

In one embodiment of the invention a loop or ring is carried by the body for carrying a jewelry component.

Still further in accordance with embodiments of the invention, a jewelry connector body is a substantially cylindrical member having at least a partially threaded bore. The cap includes a threaded portion for engaging the partially threaded bore and securing the cap to the body.

In another embodiment of the invention a linking attachment is carried by the body. The linking attachment is adapted to attach to a jewelry component. The jewelry component may be one of a jewelry clasp, jewelry chain, jewelry cable or the like.

In accordance with embodiments of the invention the cap and the body each have an exterior shape and finish that match such that the cap and body appear as a single unit when assembled together. In one embodiment of the invention, the cap and the body member are each comprised of precious metal.

The aperture is selected to be large enough such that the wire can pass therethrough and small enough to prevent the crimp attached to the wire from passing therethrough.

The cap includes a portion facilitating being gripped by an assembler's fingers.

In accordance with another embodiment of the invention, jewelry comprises a first section comprising a plurality of wired together elements and at least one jewelry connector disposed at one end of the first section. The jewelry connector includes a first connector member and a second connector member adapted for secure affixation to the first connector member. One of the first or second members has an aperture for receiving a wire extending through the first section. The other member has a loop on the opposite end to engage a linkable clasp or other linkable components. The first and second members cooperate to form a closed chamber for capturing a crimp affixed to a wire extending through the aperture into the chamber.

In accordance with another embodiment of the invention jewelry includes a first jewelry section of a plurality of wired together elements. A first jewelry connector is disposed at one end of the first section. The jewelry connector includes a first connector member; and a second connector member adapted for secure affixation to said first connector member. One of the first or second members has an aperture for receiving a wire extending through the first jewelry section. The other member has a loop on the opposite end to engage a linkable clasp or other linkable components. The first and second members cooperate to form a closed chamber for capturing a crimp affixed to a wire extending through the aperture into the chamber. A second jewelry connector is disposed at the other end of the first jewelry section. The second connector includes a third connector member; and a fourth connector member adapted for secure affixation to the third connector member. One of the third or fourth members has an aperture for receiving a wire extending through the first jewelry section. The other end of the third and fourth members has a loop on the opposite end to engage a linkable clasp or other linkable element. The third and fourth members cooperate to form a closed second chamber for capturing a second crimp affixed to the wire extending through the second aperture into the second chamber.

In accordance with another embodiment of the invention, a jewelry connector comprises a body having a chamber, and an end portion having an aperture in communication with the chamber. The aperture is sized to receive the free ends of a plurality of wires. The chamber is sized to contain the free ends of the plurality of wires. A finding is affixed to the free ends of the wires.

In an embodiment of the invention, the jewelry connector includes one of a hook or a loop coupled to the body for carrying a jewelry component.

Still further in accordance with an embodiment of the invention, the jewelry connector end portion comprises a cap and the end portion is adapted to be secured to the body to close the chamber. In an illustrative embodiment, the end portion comprises one threaded portion, and the body comprises another threaded portion for engaging the one threaded portion.

A jewelry connector in accordance with embodiments of the invention includes a linking attachment carried by the body. The linking attachment is adapted to attach to a linkable jewelry component, such as a linkable clasp. The jewelry component may comprise one of a jewelry clasp, jewelry chain, or jewelry cable, and the like. The linking attachment may comprise one of a hook or a loop.

In accordance with embodiments the invention the aperture is selected to be large enough such that the free ends of the plurality of wires can pass there through and small enough to prevent the finding from passing there through.

Still further in accordance with the embodiments of the invention jewelry comprises a plurality of interchangeable jewelry sections.

BRIEF DESCRIPTION OF THE DRAWINGS

The invention will be better understood from a reading of the following detailed description in conjunction with the drawing figures in which like reference designations are utilized to designate like elements, and in which.

DETAILED DESCRIPTION

Figure 1:
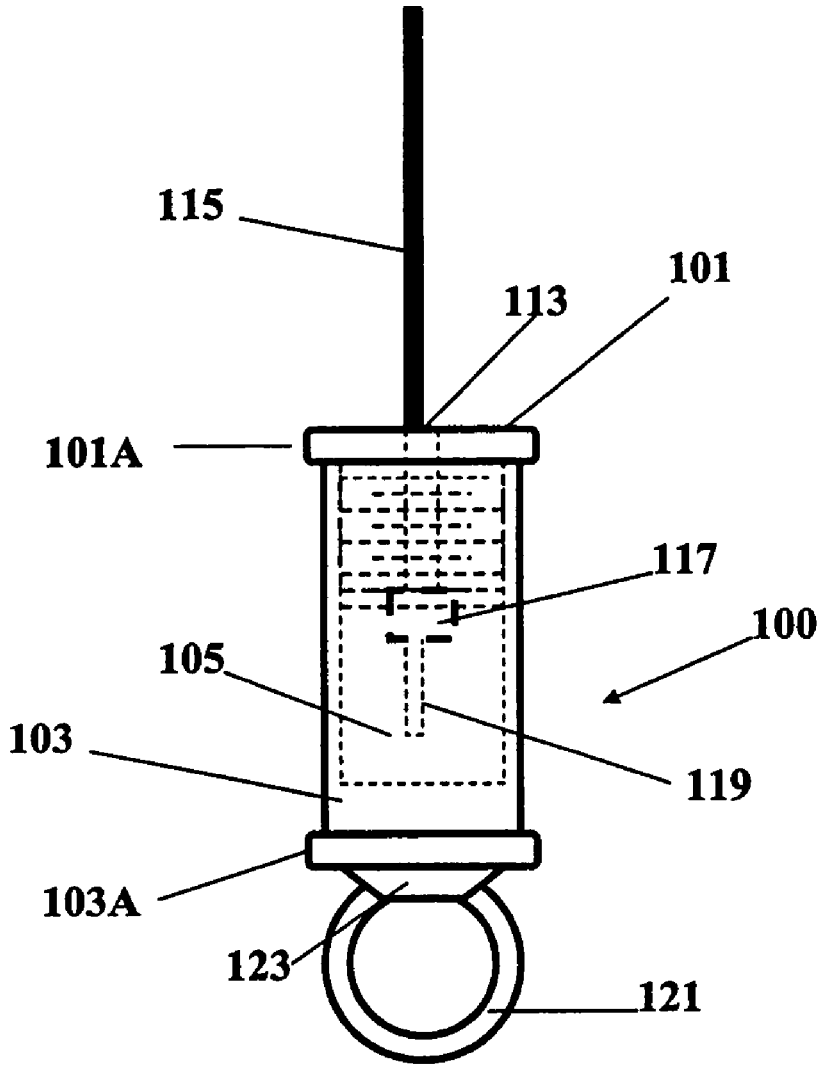
FIG. 1 illustrates a device in accordance with an embodiment of the invention.
Figure 2:
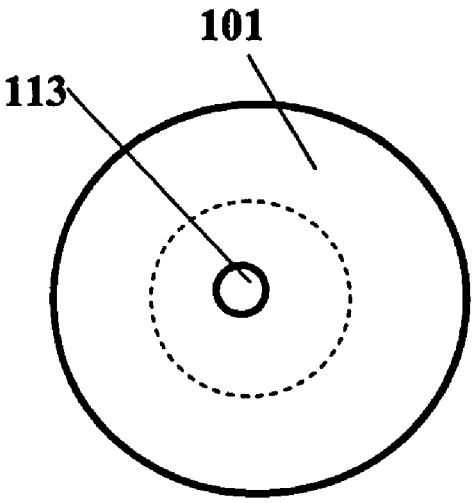
FIG. 2 is a top view of the device of FIG. 1.
Figure 3:
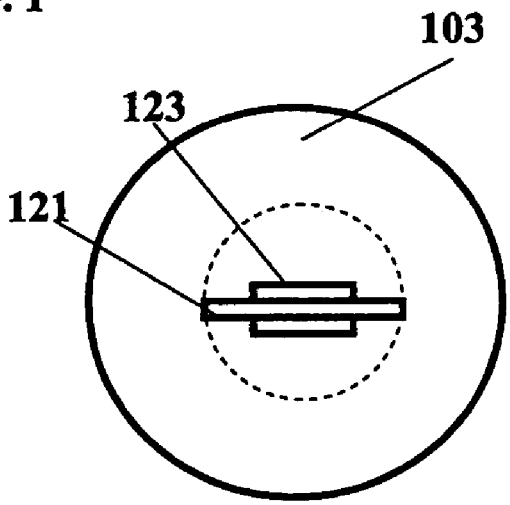
FIG. 3 is a bottom view of the device of FIG. 1.
Figure 4:
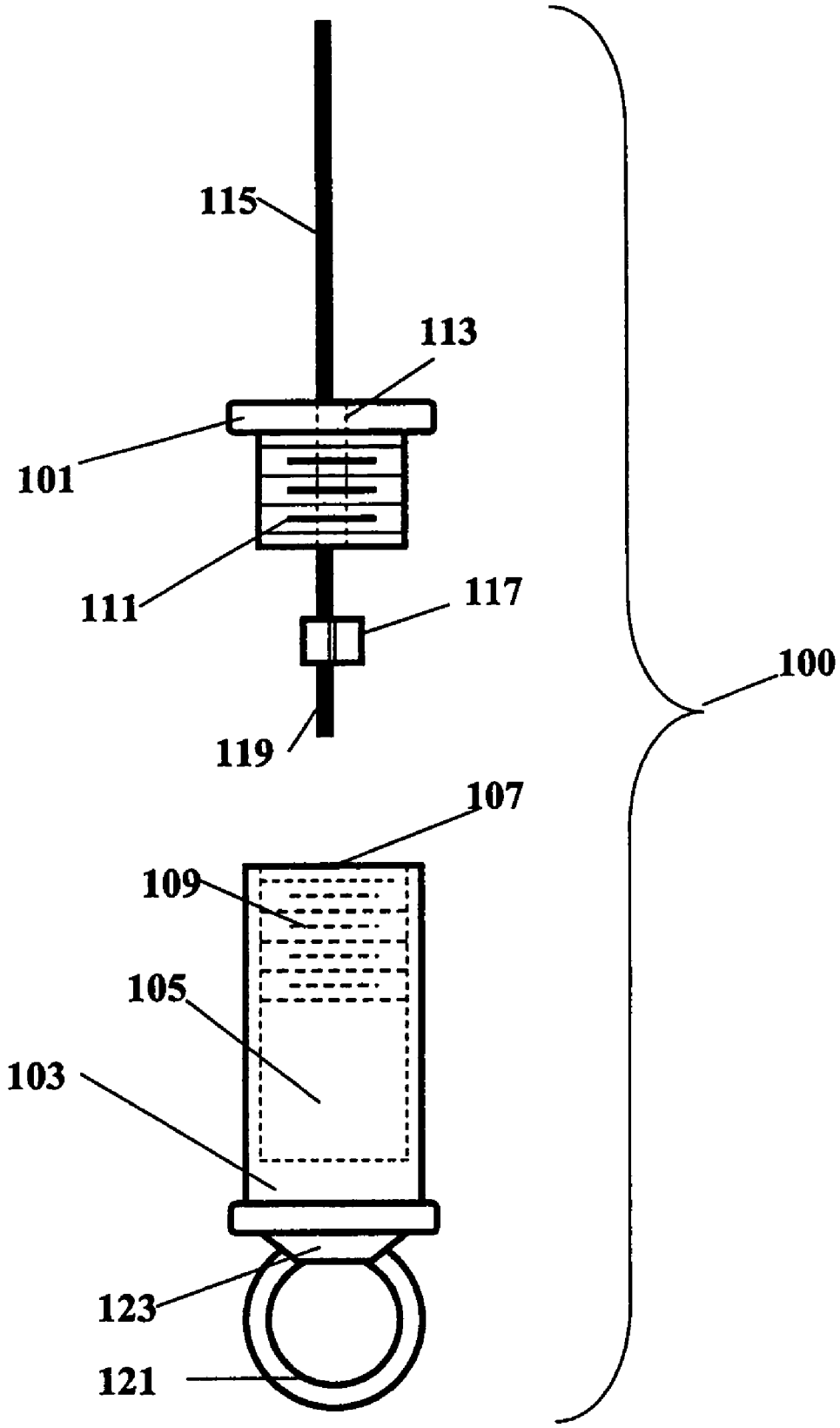
FIG. 4 is an exploded view of the device of FIG. 1 along with a wire and metal finding.

The embodiments of present invention have substantial advantages over the connection schemes for jewelry systems previously utilized. The connector used in the jewelry system of the embodiments of the present invention becomes an element of design as opposed to a deformed piece of hardware or wire used to forcefully grip ends of wires.

The jewelry connector used in the system of the various embodiments of the invention is sturdy and structurally as strong as the necklace, bracelet or other piece of jewelry in which it is used.

Turning now to the drawings, FIGS. 1 through 4 show an embodiment of a jewelry connector 100 in accordance with the principles of the invention. Jewelry connector 100 includes a first member or main body 103 and a second member or cap 101. Main body 103 includes a chamber 105 formed by a blind bore 107 in body 103. Blind bore 107 includes threads 109 that extend partially along the length of bore 107.

Cap 101 includes a threaded portion 111 that is adapted to engage threads 109. Cap 101 includes an aperture 113 that is sized to receive the end of at least one jewelry wire 115 of a strand of beads.

In utilizing the connector, the end of a jewelry wire 115 is extended through aperture 113 and a crimp 117 is affixed to the free end 119 of wire 115. The crimp is sized to prevent it, and the end of the wire 115 to which it is affixed, from being withdrawn through the aperture 113.

First member or main body 103 includes a jewelry loop 121 that is affixed thereto by solder 123. Loop 121 is utilized to attach to a linkable jewelry component such as a clasp 501, loop 503, chain 605 or other jewelry elements as shown in FIGS. 5 and 6.

First member or body 103 includes a portion 103A that more easily permits an assembler to hold first member or main body 103. Similarly, second member or cap 101 includes a portion 101A that permits the assembler to hold second member or cap 101 for assembly.

Figure 5:
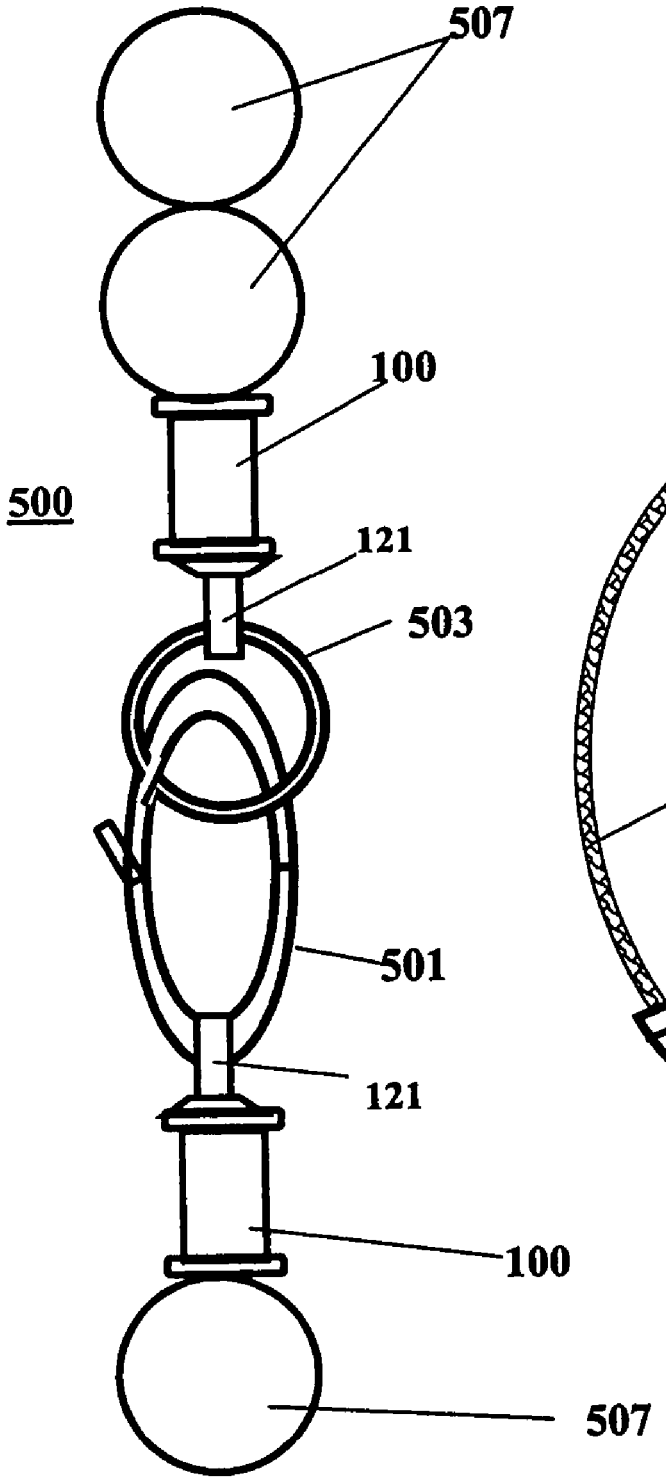
FIG. 5 is a portion of a piece of jewelry in accordance with the principles of the invention.

FIG. 5 illustrates a portion of a beaded piece of jewelry 500 having beads 507 on a wire 115 (not shown in FIG. 5). At each end of the string of beads a cap 101 (secured by a crimp 117 on the free end of the wire 115) is threaded into a main body 103 to form a connector 100 (see FIG. 4). The loop 121 of one jewelry connector 100 carries another loop 503 and the loop 121 of the other carries a clasp 501 for coupling to loop 503. The particular details of loop 503 and clasp 501 are not shown. Clasp 501 may be any well known clasp.

Figure 6:
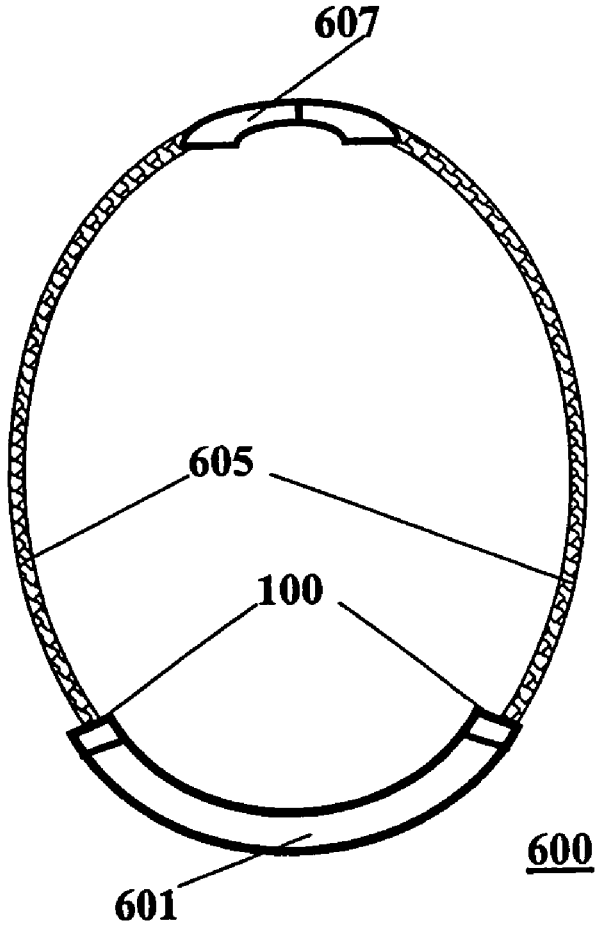
FIG. 6 illustrates a second piece of jewelry in accordance with the principles of the invention.
Figure 7:
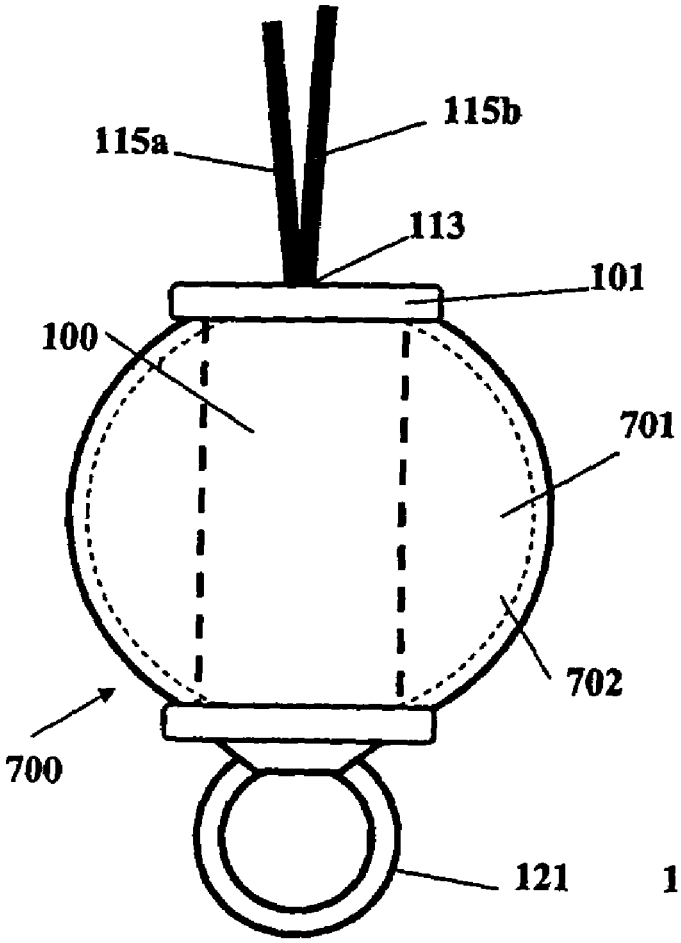
FIG. 7 illustrates a second embodiment of a device in accordance with the principles of the invention.
Figure 8:
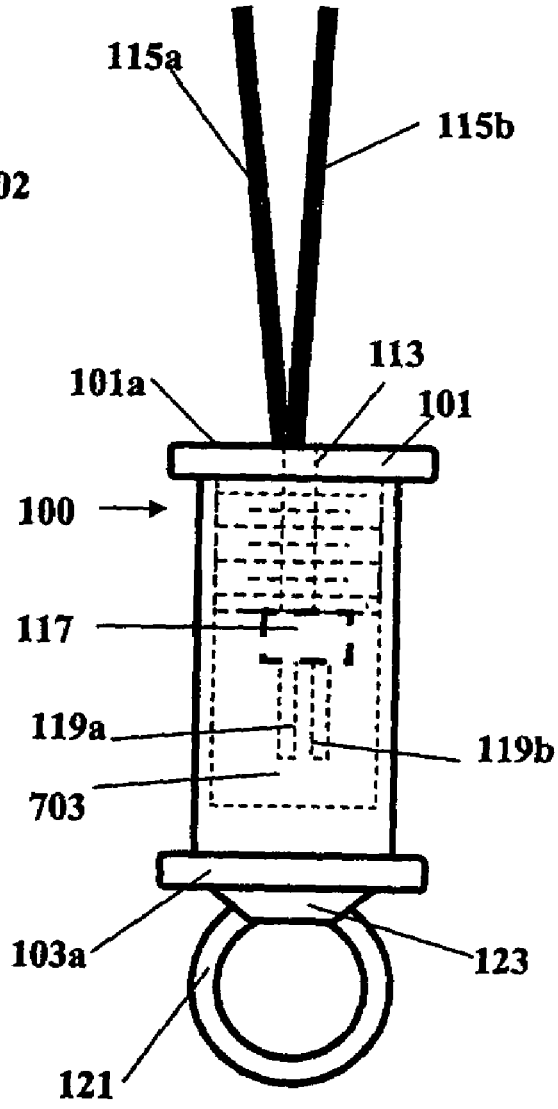
FIG. 8 illustrates a portion of the second embodiment of the invention.
Figure 9:
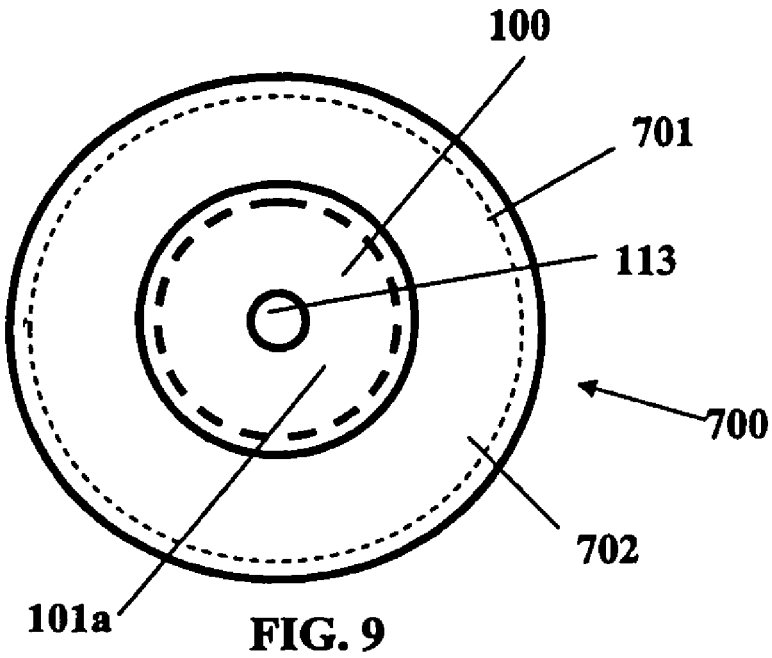
FIG. 9 is a top view of the device of FIG. 7.
Figure 10:
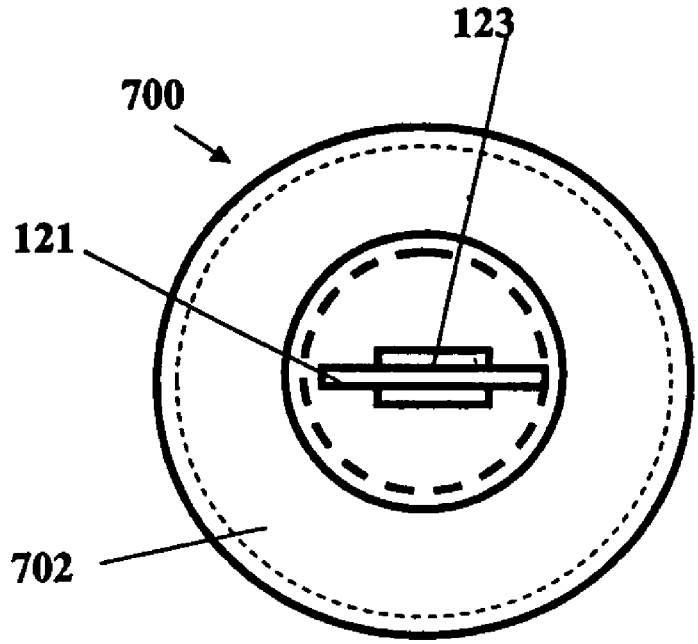
FIG. 10 is a bottom view of the device of FIG. 7.
Figure 11:
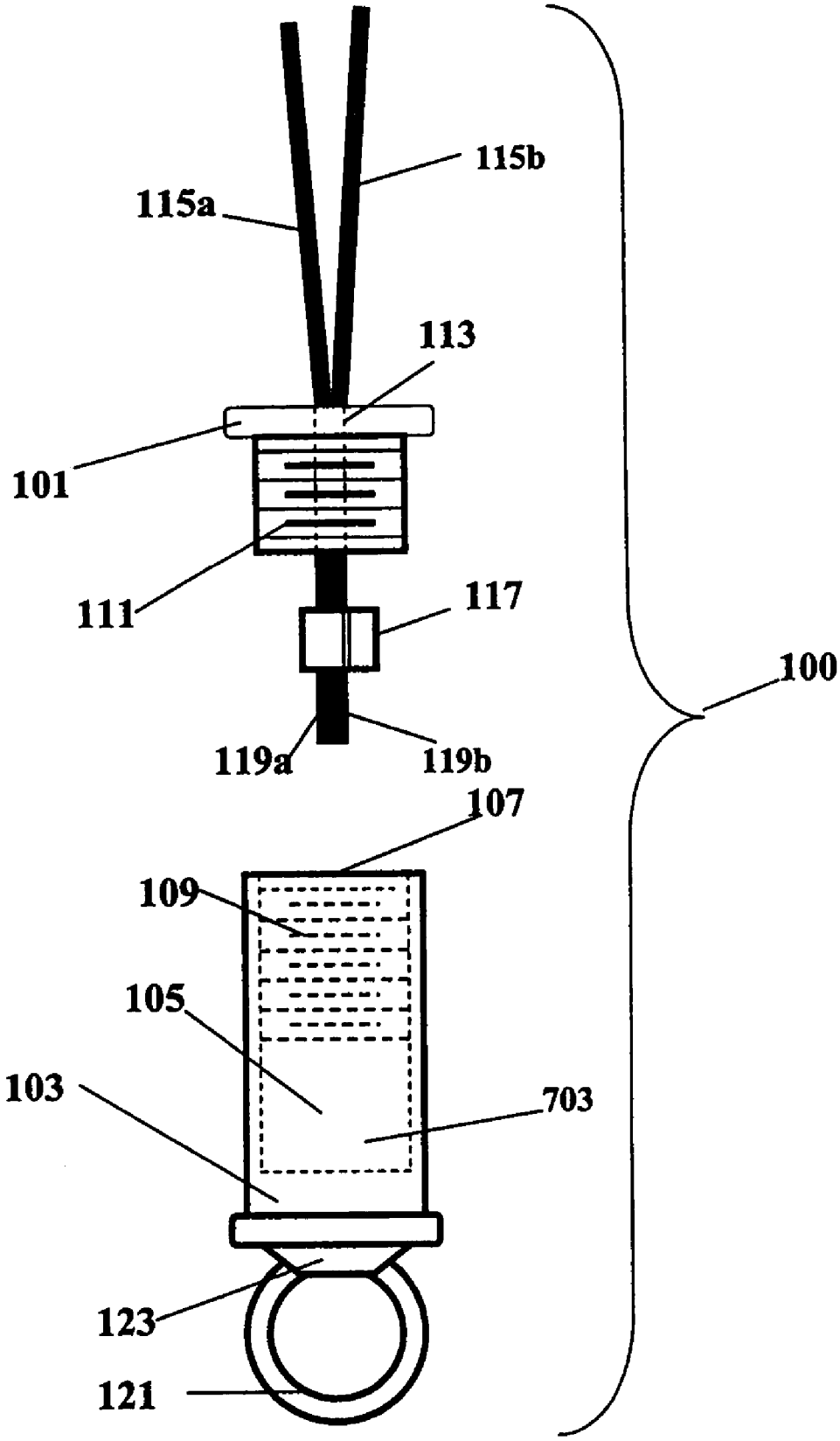
FIG. 11 is an exploded view of the portion shown in FIG. 8.

FIG. 6 illustrates another piece of jewelry 600 in accordance with an embodiment of the invention. Jewelry 600 includes a first beaded portion 601 terminated at both ends with caps 101 (not shown in FIG. 6) of jewelry connectors 100. The first beaded portion 601 is coupled through loops 121 (not shown in FIG. 6) of the connectors 100 to chains or second linkable components 605. Jewelry component 605 terminates in a conventional hook and clasp assembly 607 that is shown schematically. It is apparent that the beaded portion 601 of the piece of jewelry 600 shown in FIG. 6 may be disconnected from the chain component 605 by unscrewing the caps 101 (not shown) at each end of the beaded portion 601. A different piece, perhaps a beaded portion of jewelry of different colored beads or pearls then may be screwed into the main bodies 103 which are permanently attached to the chain components 605 to present an entirely different piece of jewelry or look, simply by substituting the beaded portion 601 with a different appearing beaded portion 601 hating the same mechanisms.

Connectors 100 are preferably formed of a metal that corresponds to the jewelry piece or system in which the connectors 100 are to be used. In one preferred embodiment of the present invention, the connector has been designed in a generally cylindrical shape, has one hole for passageway for receiving at least one free end of a wire, and a loop 121 is permanently attached at the end of the main member 103. It is understood that the connector 100 may take any decorative form or finish, additional holes for the passage of more than one wire, and another form of engagement, like a hook instead of a loop 121, to an article of jewelry without departing from the novel scope of the present invention.

FIGS. 7-14 show alternate embodiments of the invention in which a jewelry system is shown for connecting a plurality of jewelry wires. The jewelry connector 700 comprises a main body 701 which includes a chamber 703 into which the ends of a plurality of wires, such as 115*a*, 115*b* extend, with each wire secured by a finding 117. Jewelry connector body 701 includes an aperture 113 in one end portion 101 through which the plurality of wires 115*a*, 115*b* extend.

Jewelry connector body 701 includes a decorative shroud or shell portion 702 and a chambered portion 100. Chambered portion 100 is identical to jewelry connector 100 described above, with the exception that aperture 113 is sized to permit a plurality of wires 115*a*, 115*b* to extend into chamber 703 of chambered portion 100 and further sized such that finding 117 that is crimped onto wires 115*a*, 115*b* can not pass back through aperture 113 after finding 117 is crimped onto wires 115*a* and 115*b*.

Figure 12:
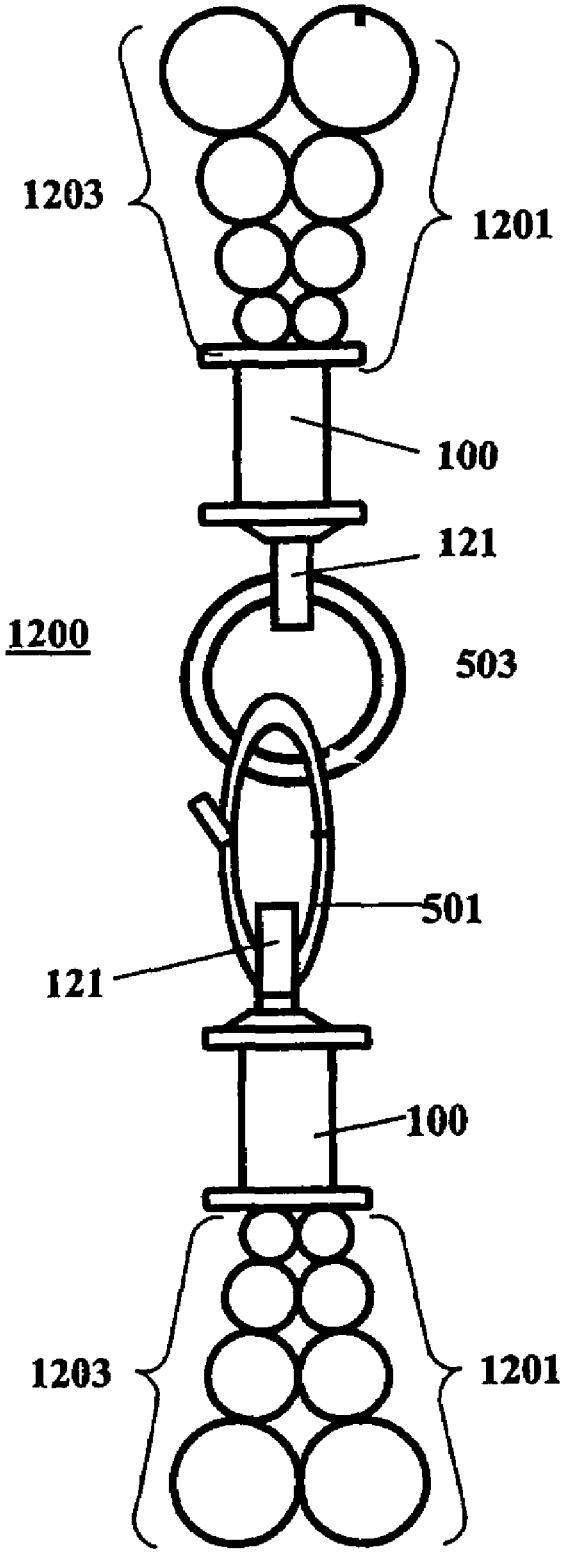
FIG. 12 illustrates a multi-strand jewelry piece utilizing the device of FIG. 1.

FIG. 12 illustrates two connectors 100 utilized to terminate both ends of bead portionss 1201, 1203 with threaded caps (not shown). Jewelry components 501, 503 are utilized to couple the two connectors 100 via the loops 121 on one end of each jewelry connector 100.

Figure 13:
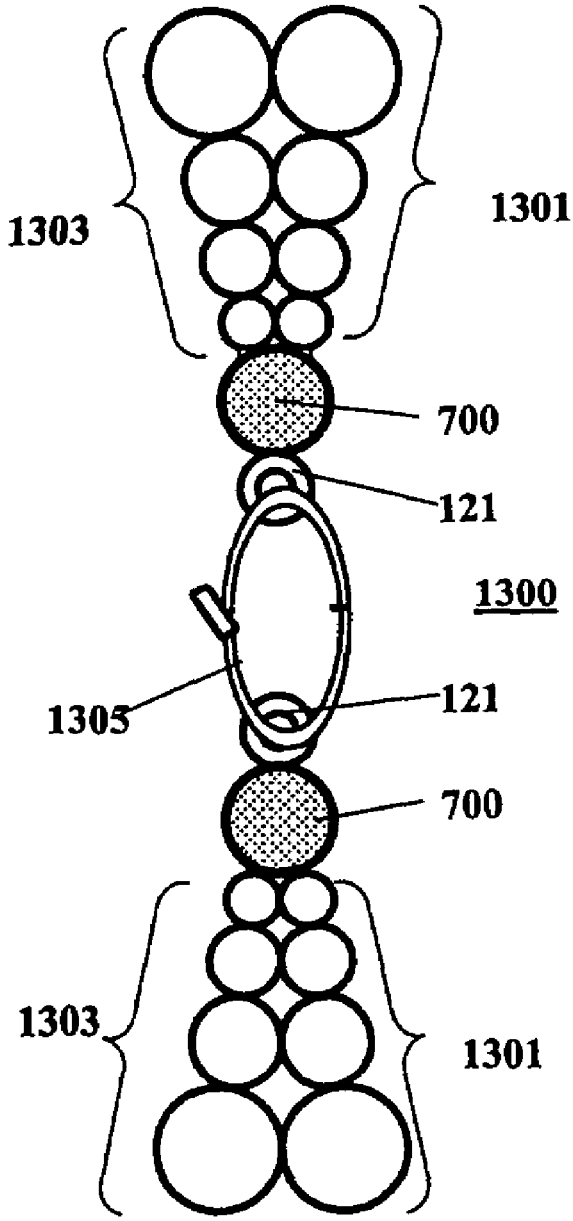
FIG. 13 illustrates a multi-strand jewelry piece utilizing the device of FIG. 7.

FIG. 13 illustrates two connectors 700 utilized to terminate both ends of two bead portions 1301, 1303 with threaded caps (not shown). Clasp component 1305 is utilized to couple the two connectors 100 via the loops 121 on one end of each jewelry connector 100. The two connectors 100 may be coupled together utilizing any known clasp component 1305 such as a hook and loop or a jewelry clasp, a jewelry chain or a jewelry cable.

Figure 14:
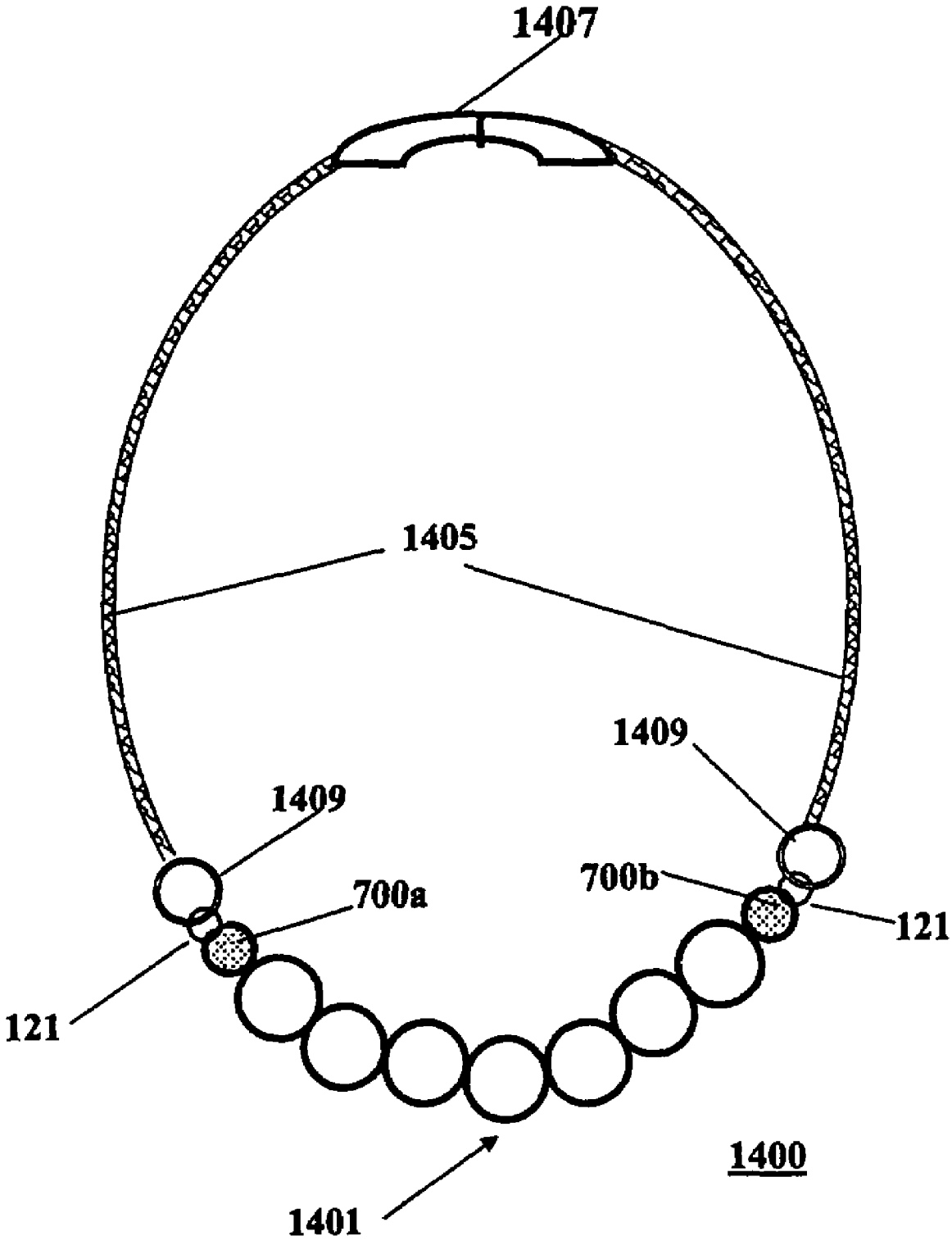
FIG. 14 illustrates a piece of jewelry utilizing the device of FIG. 7.

FIG. 14 illustrates a jewelry piece 1400 with two shrouded connectors 700*a*, 700*b* at either end of a bead section or portion 1401. Each connector 700*a*, 700*b* carries a loop 121 that engages a corresponding chain loop 1409 of chain sections or portions 1405. Jewelry chain sections or portions 1405 terminate in a known or conventional hook and clasp assembly 1407, shown schematically. The piece 1400 is similar in function and structure to the one shown in FIG. 6.

In accordance with aspects of the various embodiments of the invention, the connector body encases a chamber and is adapted to receive a cap. The size of the connector body is determined by the size of the cap or end portion, or to be compatible with adjacent components. The cap, in turn, is sized by the number of strands and size of the adjacent beads. The cap or end portion is adapted to be threaded onto the body to close the chamber.

Figure 15:
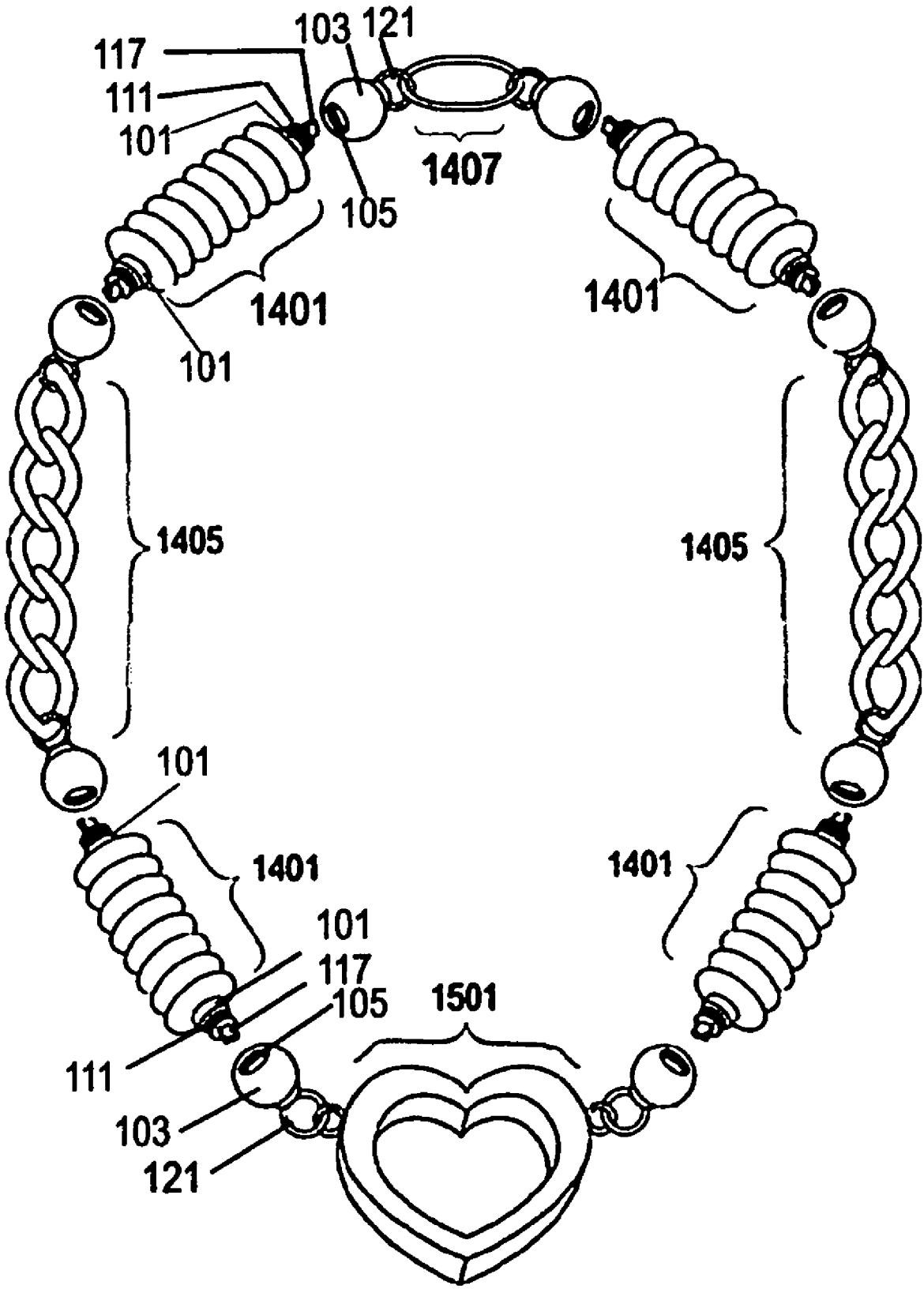
FIG. 15 illustrates a jewelry system of an embodiment of the invention.

Reference now should be made to FIG. 15, which illustrates in an exploded view a variety of the different components of the jewelry system which has been described above in conjunction with FIGS. 1 to 14 in a manner selected to emphasize the interchangeability of the different components of the jewelry system. Connectors of the type shown in FIGS. 1, 4, 5, 12 and 13, for example, are illustrated in a disconnected or exploded view similar to that of FIG. 4 for purposes of illustrating the features of interchangeability of the different parts of the embodiment described previously and shown in exploded view of FIG. 15. In order to avoid unnecessary redundancy and cluttering of the drawing of FIG. 15, not all of the different connector components have been numbered in detail; but those shown at the lower left side of FIG. 15 and the upper left side of FIG. 15 are provided with reference numbers corresponding to those used in FIGS. 1 and 4, for example. The jewelry system shown in FIG. 15 embodies the interchangeabililty of parts which has been described above in detail in conjunction with FIGS. 6 and 14. To illustrate this interchangeability, however, four different bead portions 1401 are illustrated, along with a pair chain components 1405 and a decorative heart component 1501 in conjunction with a clasp component 1407 of the type generally shown in FIGS. 14 and 6. All four of the beaded portions 1401 are terminated in a cap 101 having a threaded portion 111, with a crimp or finding 117 securing each end of the beaded portions 1401.

The chain components 1405, and jewelry component shown as the heart 1501, and the clasp portion 1407 each are terminated at opposite ends by engaging the component loops to the loop on the main body portions 103, each of which carries a chamber 105 as shown by the numbering in the lower left and upper left side of FIG. 15. The manner in which the heart component 1501, for example, is attached to the loops 121 may be in any suitable, typically permanent, manner. Similarly, the clasp component 1407 is connected to the loops 121 of the main body portions 103 in a permanent manner, as are the opposite ends of the chain components 1405.

Whenever a different appearance or jewelry configuration is desired, any one or more of the different separated components shown in FIG. 15 may be replaced with another component carrying the same part of the connectors 100 needed to interface with the mating parts. All of the beaded portions 1401 terminate with caps 101, as described above. The other components, such as the chain components 1405, the heart component 1501 and the clasp component 1407, all may be replaced with other components carrying the same end portions 103 for interengagement with caps 111 on the bead portions 1401. Different, fewer, or more bead portions than the four shown in FIG. 15 may be employed. Different chain components of various length and configurations, material, and the like, may be substituted for the one shown in FIG. 15 for use in conjunction with the bead portions 1401. For example, and by no means to be considered as limiting, the jewelry system may be employed with a different set of two longer beaded portions, such as the beaded portions 1401, to attach between the main body portions 103 of the heart component 1501 and the body portions 103 attached to the clasp component 1407, eliminating the chain components 1405 and the four shorter beaded portions 1401 shown in FIG. 15. On the other hand, all of the elements of FIG. 15 may be employed; and a different jewelry piece such as a mounted stone or diamond attached to main body portions 103 in the manner of the heart component 1501 may be substituted for the heart 1501 to give an entirely different appearance to the jewelry system shown in FIG. 15 by the simple replacement of the single component, namely the heart component 1501. Alternatively, different colors or types of beaded portion 1401 may be substituted for any one or all of the four beaded portions 1401 shown in FIG. 15, again with each of these additional or substitute bead sections terminating in a cap 101 in the same manner illustrated in FIG. 15 and described above in conjunction with various other figures. This jewelry system permits a user to change the "look" of the jewelry pieces simply by replacing the beaded portions with other beaded portions having the same threaded cap 101 and replacing the components with other components having the same mated main body portions 103 to receive the threaded cap 101.

Figure 16:
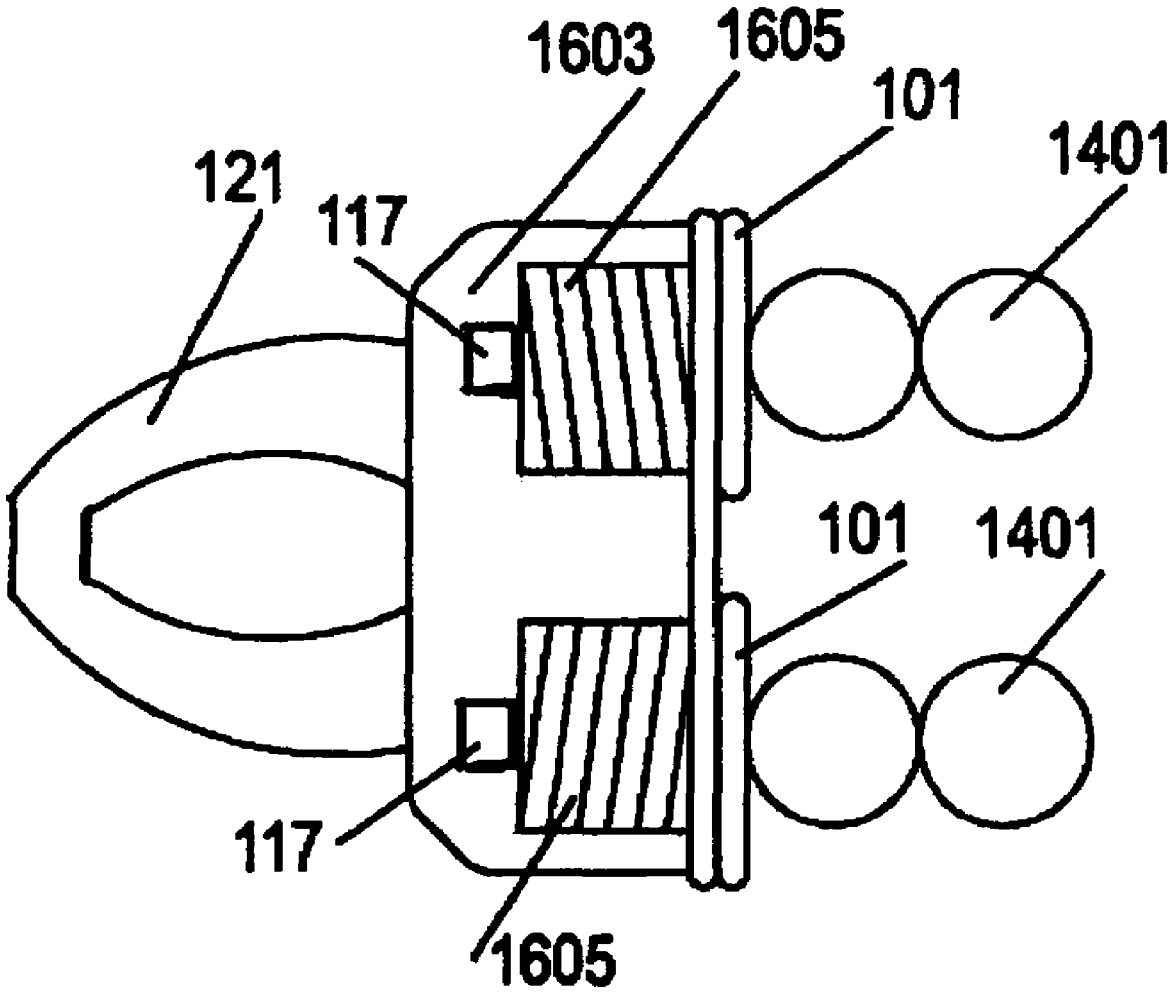
FIG. 16 illusrates a component of a third embodiment of the invention.

FIG. 16 illustrates a variation of a multiple strand (shown as a two strand element in FIG. 16) variation performing the function of the configurations shown in FIGS. 7, 8, 11, 12 and 13. In place of a single chamber as described in conjunction with these earlier figures, FIG. 16 shows a dual chamber first main body portion 1603 having two chambers 1605 in it. Both of these chambers are threaded in the same manner described in conjunction with the other embodiments to receive the threaded portion 111 of caps 101 attached, in the manner described above in conjunction with FIGS. 1 through 4, for example, to terminate beaded portions 1401. A loop or hook or other connector 121 is permanently attached to the main body 1603; and the connector of FIG. 16 may be used in the same manner as the various other connectors described above as part of an overall jewelry system.

In some applications, connectors that are required to be large in diameter have a shroud around the body. The outer surface of the shroud may be decorated to enhance the appearance of the jewelry article. On connectors without a shroud, the body may have a decorated outer surface.

It will be understood by those skilled in the art that the term wire as utilized herein includes not only jewelry wire but also is intended to include substitutes and equivalents for wire, such as string of various types, utilized in jewelry making.

The foregoing description of the embodiments of the invention is to be considered as illustrative and not as limiting. Various other changes and modifications will occur to those skilled in the art for performing substantially the same function, in substantially the same manner, to achieve substantially the same result without departing from the true scope of the invention as defined in the appended claims.

What is claimed is:

1. A jewelry system with interchangeable components and beaded portions including in combination: at least one beaded jewelry portion comprised of beads on a wire with first and second free ends; first and second caps, each having a hole therethrough to receive the first and second free ends of the wire extending through the holes in the first and second threaded caps, respectively; first and second findings permanently affixed to the first and second free ends of the wire after passage of the wire free ends through the holes in the first and second threaded caps wherein the dimensions of the holes in the first and second caps prevent passage of the first and second findings through the respective holes, thereby holding the beads on the wire between the first and second threaded caps; first and second main body portions each closed on one end and open on the opposite end, with a threaded chamber therein to receive the first and second threaded caps, respectively, with the first and second findings located in the chambers in the first and second main body portions; and a fixed loop on the closed end of each of the first and second main body portions for attachment to additional linkable components.

2. A jewelry system according to claim 1 wherein the first and second findings are crimped findings.

3. A jewelry system according to claim 2 wherein the additional linkable components include at least one linkable component attached between the fixed loops on the first and second main body portions.

4. A jewelry system according to claim 3 wherein the at least one jewelry portion comprised of beads on a wire with first and second free ends comprises a plurality of beaded portions comprised of beads on a wire with first and second free ends; first and second threaded caps for each of the plurality of beaded portions, with each of the threaded caps having a hole therethrough to receive the first and second free ends of the corresponding beaded portion, the wire extending through the first and second holes of each of the threaded caps for each of the beaded portions; and first and second findings permanently affixed to the first and second free ends of the wire of each of the beaded portions after the passage of the wire free ends through the holes in the first and second caps corresponding to each of the beaded portions wherein the dimensions of the holes in the first and second caps prevent passage of the first and second findings through the respective holes, thereby holding the beads of each of the beaded portions on the wire between the corresponding first and second caps; wherein a plurality of first and second main body portions corresponding to the number of first and second threaded caps, closed on one end and open on the opposite end each with a threaded chamber to receive a threaded cap therein, with the respective finding located in the chamber of the corresponding main body portion; and a fixed loop on the closed end of each of the plurality of main body portions for attachment to additional linkable components to permit arrangements of different beaded portions, each having threaded caps on each end with different linkable components to produce interchangeable arrangements of beaded portions and linkable components.

5. A jewelry system according to claim 4 wherein each additional linkable component is permanently attached to the loops on the closed ends of two different main body portions to engage with threaded caps on two different ends of a corresponding beaded portion.

6. A jewelry system according to claim 1 wherein the additional linkable components include at least one linkable component attached between the fixed loops on the first and second main body portions.

7. A jewelry system according to claim 1 wherein the at least one jewelry portion comprised of beads on a wire with first and second free ends comprises a plurality of beaded portions comprised of beads on a wire with first and second free ends; first and second threaded caps for each of the plurality of beaded portions, with each of the threaded caps having a hole therethrough to receive the first and second free ends of the corresponding beaded portion, the wire extending through the first and second holes of each of the threaded caps for each of the beaded portions; and first and second findings permanently affixed to the first and second free ends of the wire of each of the beaded portions after the passage of the wire free ends through the holes in the first and second caps corresponding to each of the beaded portions wherein the dimensions of the holes in the first and second caps prevent passage of the first and second findings through the respective holes, thereby holding the beads of each of the beaded portions on the wire between the corresponding first and second caps; wherein a plurality of first and second main body portions corresponding to the number of first and second threaded caps, closed on one end and open on the opposite end each with a threaded chamber to receive a threaded cap therein, with the respective finding located in the chamber of the corresponding main body portion; and a fixed loop on the closed end of each of the plurality of main body portions for attachment to additional linkable components to permit arrangements of different beaded portions, each having threaded caps on each end, with different linkable components to produce interchangeable arrangements of beaded portions and linkable components.

8. A jewelry system according to claim 7 wherein each additional linkable component is permanently attached to the loops on the closed ends of two different main body portions to engage with threaded caps on two different ends of a corresponding beaded portion.

* * * * *